US005109793A

United States Patent [19]

Ballejos

[11] Patent Number: 5,109,793

[45] Date of Patent: May 5, 1992

[54] PAINTING SHIELD APPARATUS FOR WINDOWS

[76] Inventor: Paul J. Ballejos, 1132 W. Heather, Mesa, Ariz. 85201

[21] Appl. No.: 500,531

[22] Filed: Mar. 26, 1990

[51] Int. Cl.[5] ..... B05C 21/00

[52] U.S. Cl. ..... 118/505

[58] Field of Search ..... 118/504, 505; 16/1 R; 150/154, 168; 248/264, 200.1

[56] References Cited

U.S. PATENT DOCUMENTS

| | | | |
|---|---|---|---|
| 833,557 | 10/1906 | Snyder et al. | 248/200.1 |
| 2,925,064 | 2/1960 | Kahn | 118/505 |
| 4,411,219 | 10/1983 | Keith et al. | 118/505 |

*Primary Examiner*—Richard V. Fisher
*Assistant Examiner*—Brenda Lamb
*Attorney, Agent, or Firm*—Leon Gilden

[57] ABSTRACT

Apparatus for positioning within a window framework to protect abutment portions of a window pane relative to the framework during a painting procedure. The apparatus includes an upper and lower longitudinally aligned plate member arranged parallel to one another including a plurality of biasing cylinders orthogonally arranged between the plates to extend the plates exteriorly relative to one another for interfitting within the aforenoted window framework. A positioning plate is securable to side end portions of the plates to fixedly position the plates once mounted between the aforenoted window framework. A modification of the instant invention includes the plates formed of telescoping members to permit accommodation of window frameworks of varying widths.

1 Claim, 4 Drawing Sheets

PRIOR ART

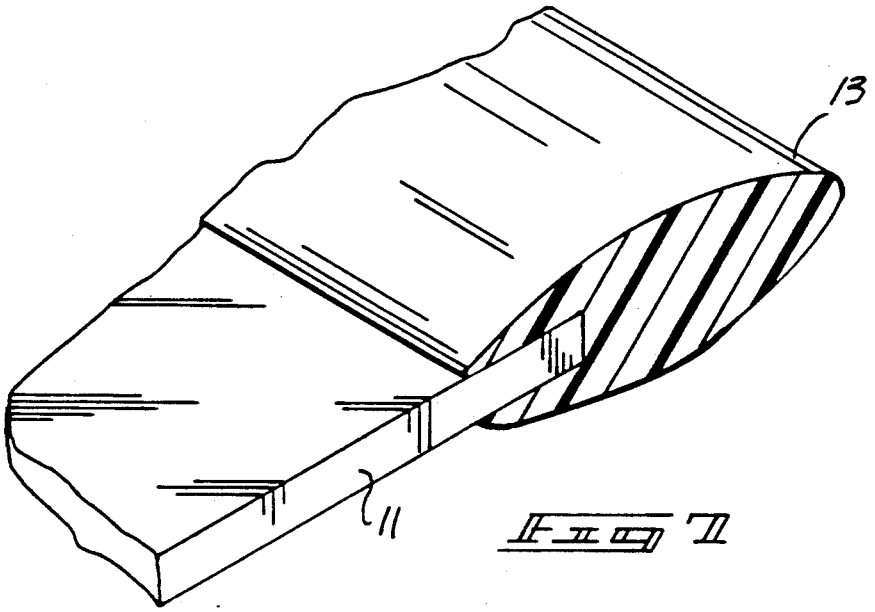
Fig 7
Fig 8
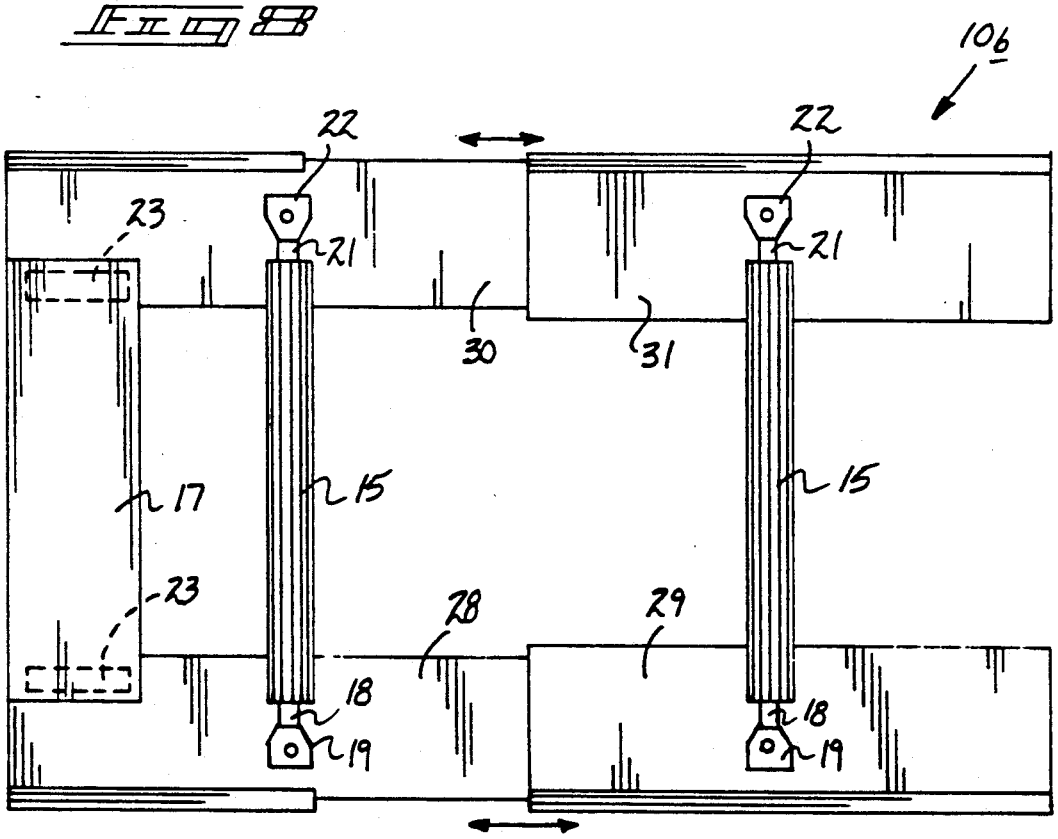

PAINTING SHIELD APPARATUS FOR WINDOWS

BACKGROUND OF THE INVENTION

1. Field of the Invention

The field of the invention relates to painting shields, and more particularly pertains to a new and improved painting shield apparatus wherein the same is positionable and received within a window framework to overlie edge portions of a window frame mounted within the window framework.

2. Description of the Prior Art

During the course of painting, the requirement to apply paint to a window framework and the like is conventionally of a time consuming and arduous labor intensive task. These tasks typically escalate costs of painting. To minimize spiraling labor costs and enhance efficient and effective painting, the instant invention is set forth to overcome low tastes of the prior art not providing the efficacy of overlying portions of a window and abutment within an associated window framework. Examples of the prior art include U.S. Pat. No. 4,331,716 to STARK wherein a painting shield utilize a plurality of plate members fixedly mounted to one another defining two adjacent sides of a truncated right or oblique pyramid wherein one of the sides extends at an oblique angle to the base of the aforenoted pyramid to overly upper edges of wall molding.

U.S. Pat. No. 4,383,496 to SHOTWELL sets forth a paint guide wherein a planar plate includes a bracket member secured at an upper end thereof for positioning against a framework during a painting procedure.

U.S. Pat. No. 4,398,495 to HARRIS, JR. et al sets forth a painting shield comprising a thin rectangular sheet with a longitudinal crease formed within the sheet as well as a transverse crease to permit bending of the shield about adjacent corners of a surface to be protected during a painting procedure.

U.S. Pat. No. 4,325,323 to RIOUX sets forth an apparatus for protecting a baseboard wherein a cart like member includes extensible plate extending from each end of the cart to overlie the aforenoted baseboard.

U.S. Pat. No. 4,536,913 to MORAWSKI sets forth a hanging guard hand tool utilizing a series of angularly oriented plate members to permit overlying various portions of surfaces to be protected during painting.

As such, it may be appreciated that there continues to be a need for a new and improved painting shield apparatus as addressed by the instant invention which overcomes the problems of ease of use as well as effectiveness in construction to effectively and efficiently overly window pane portions and abutment with a window frame to protect the window pane portions during a painting procedure and as such, the present invention substantially fulfills this need.

SUMMARY OF THE INVENTION

In view of the foregoing disadvantages inherent in the known types of painting shield apparatus present in the prior art, the present invention provides a new and improved painting shield apparatus wherein the same includes a plurality of biased plate members arranged parallel to one another to extend in opposed directions relative to one another to overly window pane portions during a painting procedure. As such, the general purpose of the present invention, which will be described subsequently in greater detail, is to provide a new and improved painting shield apparatus which has all the advantages of the prior art painting shield apparatus and none of the disadvantages.

To attain this, the painting shield apparatus of the instant invention includes apparatus for positioning within a window framework to protect abutment portions of a window pane relative to the framework during a painting procedure. The apparatus includes an upper and lower longitudinally aligned plate member arranged parallel to one another including a plurality of biasing cylinders orthogonally arranged between the plates to extend the plates exteriorly relative to one another for interfitting within the aforenoted window framework. A positioning plate is securable to side end portions of the plates to fixedly position the plates once mounted between the aforenoted window framework. A modification of the instant invention includes the plates formed of telescoping members to permit accommodation of window frameworks of varying widths.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the apllication, which is measured by the claims, nor is it intended to be limiting as to the scope of the invention in any way.

It is therefore an object of the present invention to provide a new and improved painting shield apparatus which has all the advantages of the prior art painting shield apparatuses and none of the disadvantages.

It is another object of the present invention to provide a new and improved painting shield apparatus which may be easily and efficiently manufactured and marketed.

It is a further object of the present invention to provide a new and improved painting shield apparatus which is of a durable and reliable construction.

An even further object of the present invention is to provide a new and improved painting shield apparatus which is susceptible of a low cost of manufacture with regard to both materials and labor, and which accordingly is then susceptible of low prices of sale to the consuming public, thereby making such painting shield apparatuses economically available to the buying public.

Still yet another object of the present invention is to provide a new and improved painting shield apparatus which provides in the apparatuses and methods of the prior art some of the advantages thereof, while simultaneously overcoming some of the disadvantages normally associated therewith.

Still another object of the present invention is to provide a new and improved painting shield apparatus which may be compactly stored when not being utilized.

Yet another object of the present invention is to provide a new and improved painting shield apparatus wherein the same is positionable within a window framework to overly the transparent window pane portions and protect same during a painting procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a partial isometric illustration of the forward terminal ends of each shield utilized by the instant invention.

FIG. 8 is a top orthographic view of a modified painting shield organization utilized by the instant invention.

DESCRIPTION OF THE PREFERRED EMBODIMENT

Figure 1:
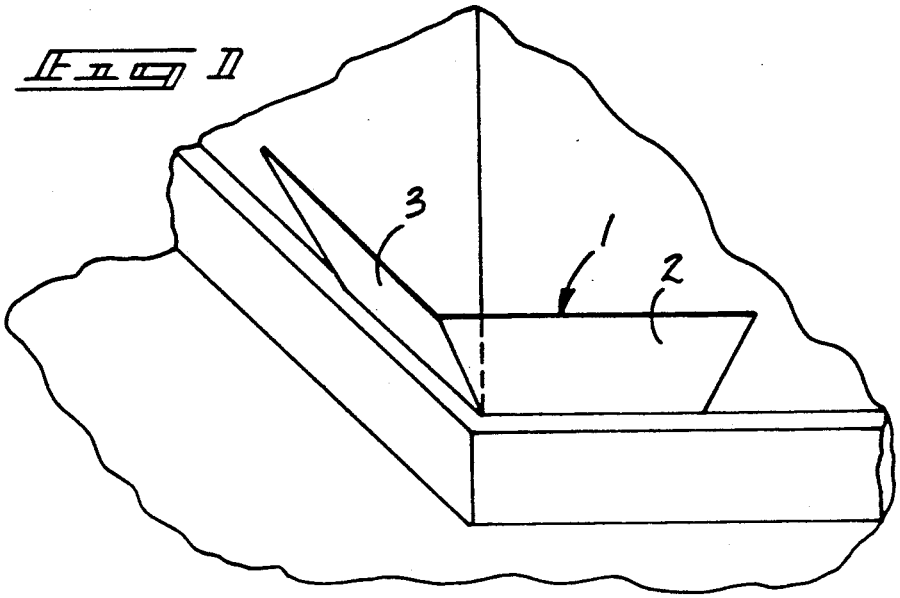
FIG. 1 is an isometric illustration of a prior art painting shield apparatus.

With reference now to the drawings, and in particular to FIGS. 1 to 8 thereof, a new improved painting shield apparatus embodying the principles and concepts of the present invention and generally designated by the reference numerals 10, 10*a*, and 10*b* will be described.

Figure 2:
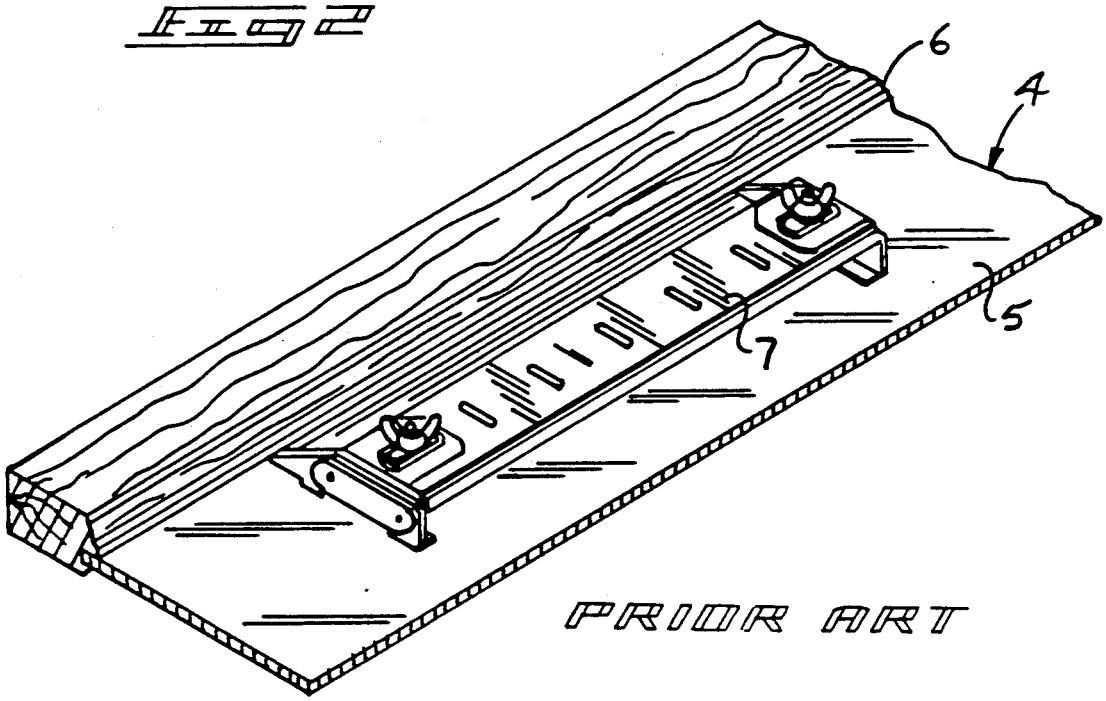
PRIOR ART Fig 2
FIG. 2 is an isometric illustration of a further prior art painting shield apparatus.

FIG. 1 illustrates a prior art painting shield 1 including a first planar plate 2 mounted to a second planar plate 3 defining two sides of a truncated pyramidal structure where at least one of the sides is arranged at an oblique angle relative to the base of the pyramid as opposed to the other side. The prior art painting shield apparatus 4 as illustrated in FIG. 2 utilizes a planar plate 5 for abutement against an associated window type framework 6 with a bracket member 7 to permit manual positioning of the apparatus.

Figure 3A:
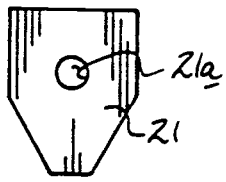
FIG. 3A is an orthographic side view, somewhat enlarged, of a foot member utilized by the invention as illustrated in FIG. 3.
Figure 3:
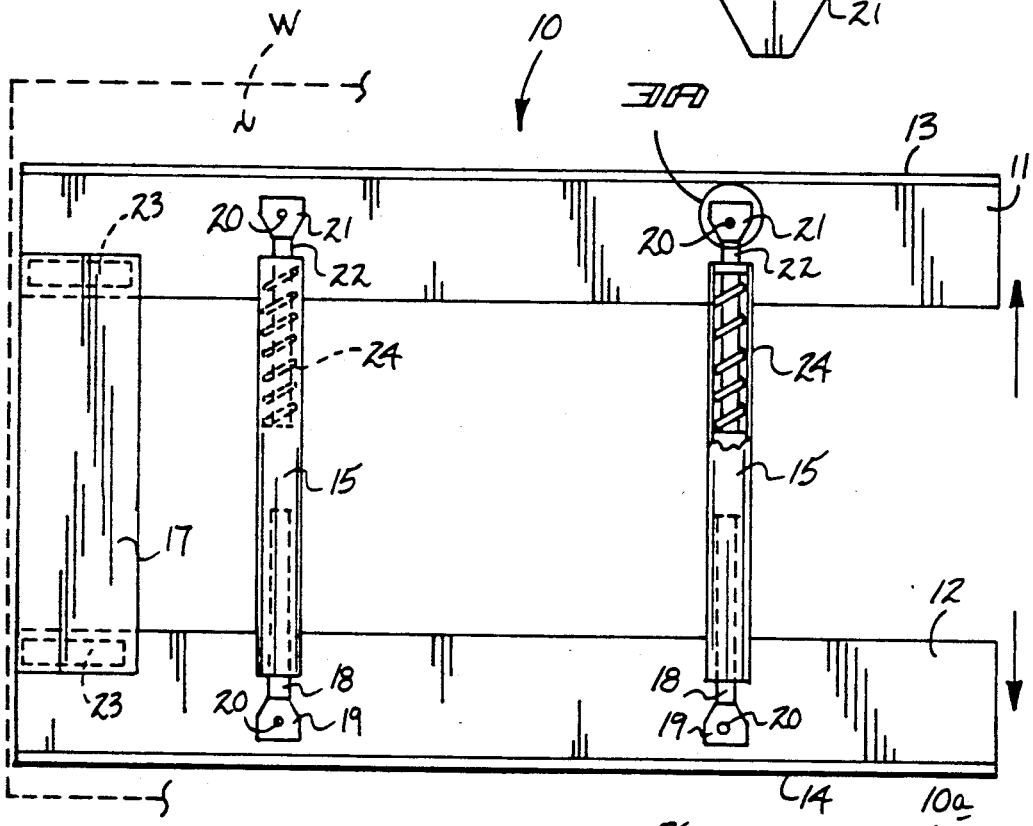
FIG. 3 is a top orthographic view of the instant invention.

More specifically, the painting shield apparatus 10 of the instant invention essentially comprises a first elongate longitudinally aligned plate 11 spaced from and biased exteriorly from a second elongate longitudinally aligned plate 12. The first and second plates 11 and 12 are positioned to be received within a surrounding window framework W as illustrated in FIG. 3. The first plate 11 includes a first outer edge 13 while the second plate 12 includes a second outer edge 14. The first and second outer edges typically utilize a polymeric edge of a generally elliptical cross-sectional configuration coextensive with each plate to accommodate compression and enhance sealing of each edge in abutment with interior surface of the surrounding window framework W. A plurality of elongate extension cylinders 15 are orthogonally arranged relative to the first and second plates 11 and 12 and are parallel to one another as illustrated in FIG. 3 for example. The cylinders each include a lower fixed cylindrical rod 18 coaxially aligned with the cylinder 15 and an outwardly biased upper cylindrical rod 22. The upper cylindrical rods 22 each includes an extension spring 24 whose lower end is fixedly mounted within the cylinder 15 and is arranged to bias the respective upper cylinder cylindrical rods 22 outwardly relative to the cylinders 15. The lower fixed cylinders 18 includes lower foot members 19 each including an aperture 19*a* directed therethrough to receive a fastener 20 through the apertures to secure the foot members 19 and the associated lower cylindrical rods 18 to the second plate 12. Upper foot members 21 are mounted to upper terminal ends of the upper cylindrical rods 22 and include apertures 21*a* to receive associated fasteners 20 therethrough to fixedly mount the upper cylindrical rods 22 to the first plate 11. A positioning member 17 defined as a plate is securable to aligned respective ends of the first and second plates 11 and 12 as illustrated in FIG. 3. Magnets 23 are mounted adjacent with and coextensively to opposed end edges of the positioning member 17 to fixedly secure the positioning plate 17 to a respective pair of opposed ends of the first and second plates 11 and 12 to further assist in maintaining a fixed distance between the plates 11 and 12 once a predetermined spacing has been determined.

Figure 4:
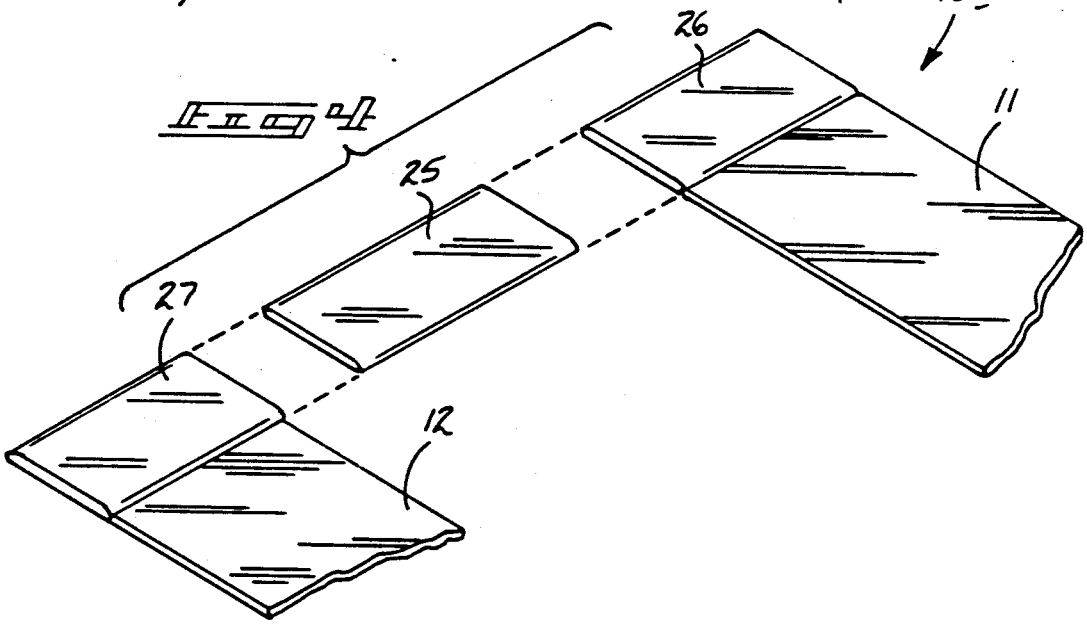
FIG. 4 is an isometric illustration of a modified position member utilized by the instant invention in selective positioning of the spaced planar members relative to one another.
Figure 5:
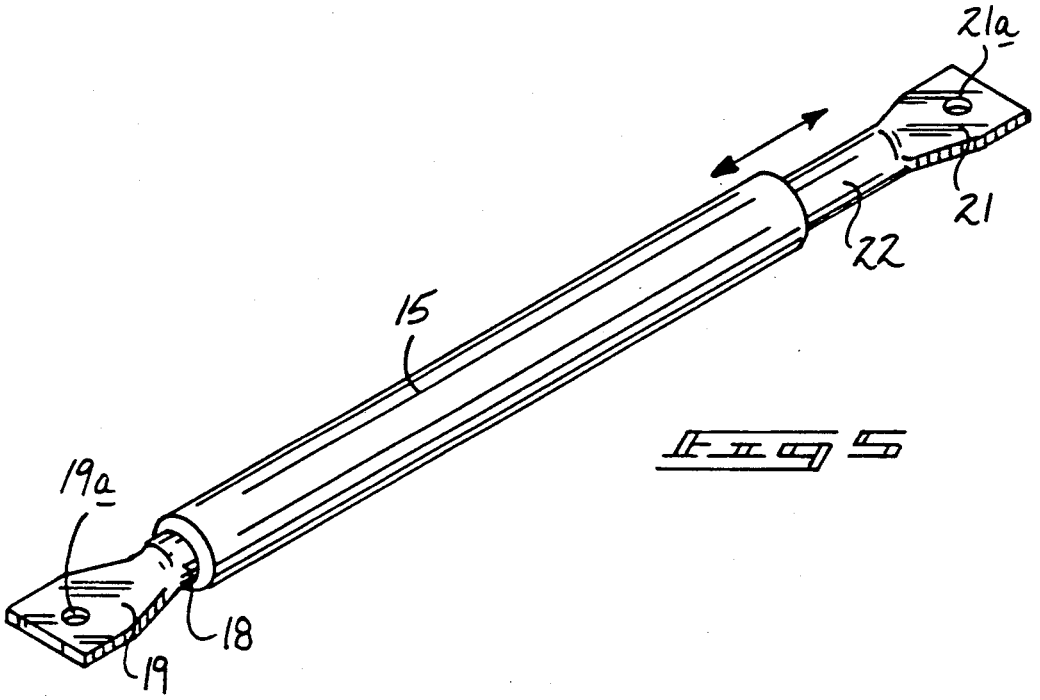
FIG. 5 is an isometric illustration of the cylinder member utilized by the instant invention.
Figure 6:
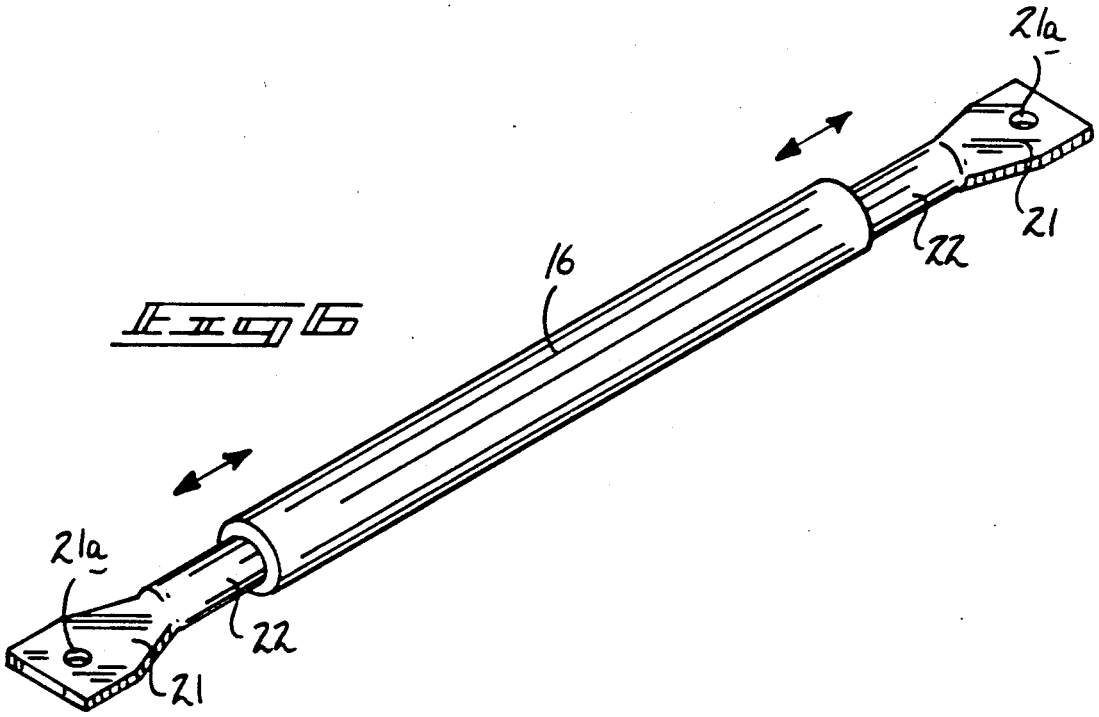
FIG. 6 is an isometric illustration of a modified cylinder member utilized by the instant invention.

FIG. 4 illustrates a modified shield apparatus 10*a* wherein the positioning plate is defined as a modified positioning member 25 defined by a predetermined cross-sectional configuration and each end of each first and second plate 11 and 12 respectively includes a first and second friction sleeve 26 and 27 defined by an internal cross-sectional configuration equal to the predetermined cross-sectional configuration of the modified positioning member 25 to fixedly mount the positioning member 25 and the plates 11 and 12 in a predetermined spacing. FIG. 5 illustrates the cylinder 15 as utilized by the instant invention with the upper outwardly biased cylindrical rod 22 utilized whereas FIG. 6 illustrates a modified cylindrical member 16 wherein the upper and lower cylindrical rods each include an outwardly biased cylindrical rod 22 to double the biasing force of the organization in outwardly biasing the plate 11 and 12 relative to one another for positioning within a window frame W to enhance engagement within a window frame.

FIG. 8 illustrates a further modified apparatus 10*b* wherein the lower or second plate includes a first lower plate 28 telescoping receivable within a second lower plate 29 while the upper or first plate includes a first upper plate 30 telescopingly receivable within a second upper plate 31. In this manner, the upper and lower plates accommodate various widths of a window frame W to overly associated window pane surface in abutting engagement with the aforenoted window frame W.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obivious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A painting shield apparatus, comprising in combination, a first elongate longitudinally aligned plate spaced from and parallel to a second elongate longitudinally aligned plate, wherein the first and second plates are arranged to lie in a common plane, and the first plate includes a first outer edge and the second plate includes a second outer edge, wherein the first and second outer edges are arranged at an exterior portion of each plate and are parallel to one another, and the first and second plates include biasing means to bias the first and second plates away from one another, and a positioning means to secure the first and second plates in a fixed position relative to one another and located at the opposite ends of the first and second plates, and wherein the biasing means includes a first and second biasing cylinder, the first and second biasing cylinder arranged parallel to one another and each cylinder orthogonally mounted to the first and second plate, and wherein the lower rod is telescopingly received coaxially arranged within the biasing cylinder mounted to the second plate and an upper rod telescopingly received within the biasing cylinder mounted at its upper end to the first plate, and the upper rod including a spring mounted within the cylinder in association with the upper rod to bias the upper rod exteriorly of the biasing cylinder, and wherrein the lower rod is telescopingly received within the biasing cylinder and includes a biasing means to bias the lower rod exteriorly of the biasing cylinder, and wherein the first and second edge each are defined as an elongate polymeric edge, each edge includes an elliptical cross-sectional configuration to accommodate compression and enhance sealing against an associated window frame, and wherein the first plate includes a first member telescopingly receivable within a second member, and the second plate includes a third member telescopingly receivable within a fourth member, the first and second plates adjustable to accommodate various widths of window frames, and wherein the positioning member includes a first magnet and a second magnet, the first magnet arranged parallel to and adjacent an upper edge of the positioning member and the second magnet arranged adjacent to a lower end of positioning member, the first and second magnet is positioned to overlie opposed upper surfaces of the first and second plates to secure the positioning to the first and second plates, and wherein the positioning member includes an elongate member defined by a predetermined cross-sectional configuration, and further including a first sleeve orthogonally arranged relative to the first plate and a second sleeve orthogonally mounted overlying the second plate, wherein the first and second sleeve are coaxially aligned relative to one another and each sleeve is defined by a cross-sectional configuration equal to the predetermined cross-sectional configuration.

* * * * *